US007478638B2

(12) United States Patent
Rizzoli et al.

(10) Patent No.: US 7,478,638 B2
(45) Date of Patent: Jan. 20, 2009

(54) MACHINE FOR MANUFACTURING TOBACCO PRODUCTS

(75) Inventors: Salvatore Rizzoli, Bologna (IT); Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 570 days.

(21) Appl. No.: 10/833,105

(22) Filed: Apr. 28, 2004

(65) Prior Publication Data

US 2004/0216754 A1 Nov. 4, 2004

(30) Foreign Application Priority Data

Apr. 29, 2003 (IT) ..... BO2003A0247

(51) Int. Cl.
*A24C 5/32* (2006.01)
*A24C 5/34* (2006.01)

(52) U.S. Cl. ..... 131/280; 356/73; 356/445; 356/446

(58) Field of Classification Search ..... 131/280
See application file for complete search history.

(56) References Cited

U.S. PATENT DOCUMENTS 3,758,050 A * 9/1973 Watts et al. ..... 406/190
4,283,766 A * 8/1981 Snyder et al. ..... 382/293
4,373,806 A * 2/1983 Tipper ..... 356/23
5,680,215 A * 10/1997 Huber et al. ..... 356/600
6,816,625 B2 * 11/2004 Lewis et al. ..... 382/275
2002/0041383 A1 4/2002 Lewis

FOREIGN PATENT DOCUMENTS

DE 10024284 11/2002

OTHER PUBLICATIONS

DE 10024284A1; Inventors: Torsten Morke, Berthold Maiwald; publication date: Nov. 22, 2001 (pp. 16-17 and drawing).*

* cited by examiner

*Primary Examiner*—Philip C Tucker
*Assistant Examiner*—Phu H Nguyen
(74) *Attorney, Agent, or Firm*—Timothy J. Klima

(57) ABSTRACT

Tobacco products are manufactured by an automatic machine presenting a number of working parts, certain of which consisting in rollers rotatable about mutually parallel axes and carried by a substantially vertical bulkhead of the machine frame, equipped with a protective casing rendered capable of movement by means of a parallelogram linkage between a raised position, clear of the bulkhead, and a lowered position shielding the bulkhead. A horizontal beam associated permanently with the casing carries an upright member serving to support a camera-and-strobe-light assembly; piloted by a master controller, the upright member is traversed along the beam by one motor, and the camera-and-strobe-light assembly along the upright member by another motor, so that the camera can be positioned at any given point on the bulkhead to examine all the working parts.

11 Claims, 2 Drawing Sheets

MACHINE FOR MANUFACTURING TOBACCO PRODUCTS

BACKGROUND OF THE INVENTION

The present invention relates to a machine for making tobacco products.

In particular, the present invention relates to a cigarette maker, packer, or wrapper. Reference is made explicitly in the present specification to a filter tip attachment machine, albeit implying no limitation.

Filter tip attachment machines typically present an infeed end supplied with filter-less cigarettes by a cigarette maker, and will comprise a train of rollers departing from the infeed end, rotatable about mutually parallel axes, along which single cigarette sticks and filters are made to advance in succession, passing through a series of processing stations and emerging ultimately as filter-tipped cigarettes. From the outfeed end of the train of rollers, the finished cigarettes are directed into a packer.

To the end that the cigarette sticks and filters can be advanced through the machine and transferred from one roller to the next, the outer surfaces of the rollers are fluted, fashioned with aspirating grooves in which relative sticks and/or filters are retained by suction.

The aspirating grooves lie parallel to the axis of the roller and present a cross sectional profile appearing as an arc to a circle, the bottom surface of each groove incorporating a plurality of suction holes connected to a source of negative pressure by way of relative valves operating on a pneumatic circuit in such a way as will allow the cigarettes to be transferred from one roller to the next.

The task of supervising a machine of this type is entrusted to an operator who, in the event of any fault or malfunction occurring, will proceed to identify the causes and restore correct operation. To identify the site of the trouble and examine the causes, the operator uses a strobe lamp, that is to say, an intermittent light source of controllable frequency.

By setting the strobe at a given frequency, it becomes possible for moving parts driven cyclically in rotation, and in particular the aforementioned rollers, to be observed at rest or in continuous motion at low speed.

Should it be appropriate to record or document a given fault or malfunction, the operator will film the event using a television camera, in conjunction with the strobe lamp.

This manual type of supervision is particularly laborious, not least in view of the large expanses covered by the machinery being investigated, also the considerable number of electrical connections required for the inspection devices, which indeed can represent a source of danger to the operator, especially when working near moving parts.

The object of the present invention is to provide an automatic machine such as will be unaffected by the aforementioned drawbacks, and in which it will be possible to identify the site of a fault and examine the cause swiftly, accurately and safely.

SUMMARY OF THE INVENTION

The stated object is realized according to the present invention in a machine for manufacturing tobacco products that comprises a plurality of working parts occupying a predetermined zone, certain of which at least are invested with cyclical motion, and an inspection unit comprising inspection means. To advantage, the inspection unit is structured in such a way that the inspection means can be set in motion along at least two axes and positioned thus at any given point within the compass of the predetermined zone.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
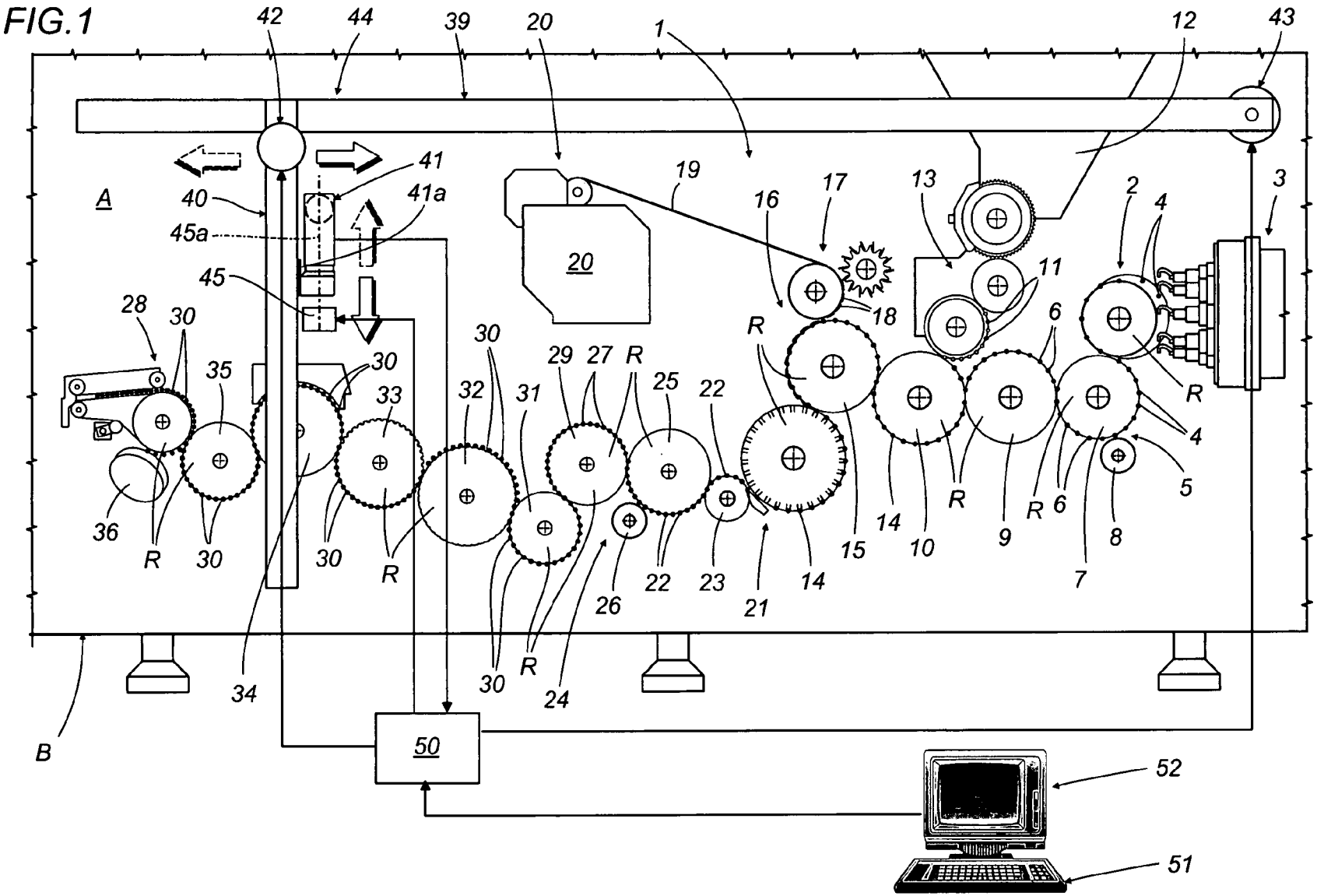
FIG. 1 illustrates a filter tip attachment machine according to the present invention, viewed schematically and in elevation.

Referring to FIG. 1 of the drawings, 1 denotes a filter tip attachment machine, in its entirety, comprising a plurality of working parts, certain of which consisting in a train of components set in motion cyclically at constant speed and embodied as a plurality of rollers, denoted R generically, each furnished with respective aspirating grooves.

The rollers R are rotatable about mutually parallel axes and carried thus by a substantially vertical bulkhead A surmounting a frame B.

In addition to the rollers R, the working parts include other devices such as, for example, filter plug feed hoppers, wrapping material feed lines and the like, all of which occupying a predetermined area along the aforementioned bulkhead A.

The first of the rollers R, an infeed roller denoted 2, is coupled to the outfeed of a cigarette maker of conventional type (not illustrated) by way of a revolving transfer unit 3.

The transfer unit 3 is designed, in conventional manner, to place double length cigarette sticks 4 in the grooves of the infeed roller 2, which will be set in rotation about an axis normal to the bulkhead A, turning counterclockwise as viewed in FIG. 1.

The double length sticks 4 are transferred from the infeed roller 2 to a cutting station 5, where each is divided into two single cigarette sticks 6 by a roller 7 and a disc cutter 8.

The single cigarette sticks 6 are transferred from the roller 7 of the cutting station, by way of a distancing roller 9 that serves to separate each pair of sticks 6 axially one from another, to an assembly roller 10 where a double length filter plug 11 is placed between the two sticks 6 of each successive pair. The filter plugs 11 are dispensed from a hopper 12 via a succession of rollers 13, each becoming part of an assembly 14 that comprises two single cigarette sticks 6 and a double length filter plug 11 interposed between the two.

The assemblies 14 are released by the roller 10 to a second roller 15 forming part of a finishing unit 16, which also includes a unit 17 serving to cut and feed single tipping papers 18 obtained from a continuous strip 19 supplied by a relative feed unit 20 and used to join together the component parts of each assembly 14.

The finishing unit 16 further comprises a rolling unit 21 of familiar type by which the assemblies 14 and tipping papers 18 are received in succession and in such a way that each paper 18 can be rolled around a respective assembly 14 to form a double length cigarette 22.

The double length cigarettes 22 are directed by way of an intermediate roller 23 into a cutting unit 24 comprising a roller 25 and a disc cutter 26 such as will divide each double cigarette 22 by slicing through the double length filter plug 11, and thus generate two successions of single filter cigarettes 27 identical one to another (of which one only is visible in FIG. 1).

The two successions of filter cigarettes 27 are directed toward an outfeed unit 28 of the filter tip attachment machine 1, advancing first onto an overturning roller 29 by which the two successions are united to establish a single succession of cigarettes 30, then proceeding along a final train of rollers R denoted 31, 32, 33, 34, 35 and 36 and following a path along which the cigarettes 27 will undergo further finishing and quality control steps of a familiar nature.

Figure 2:
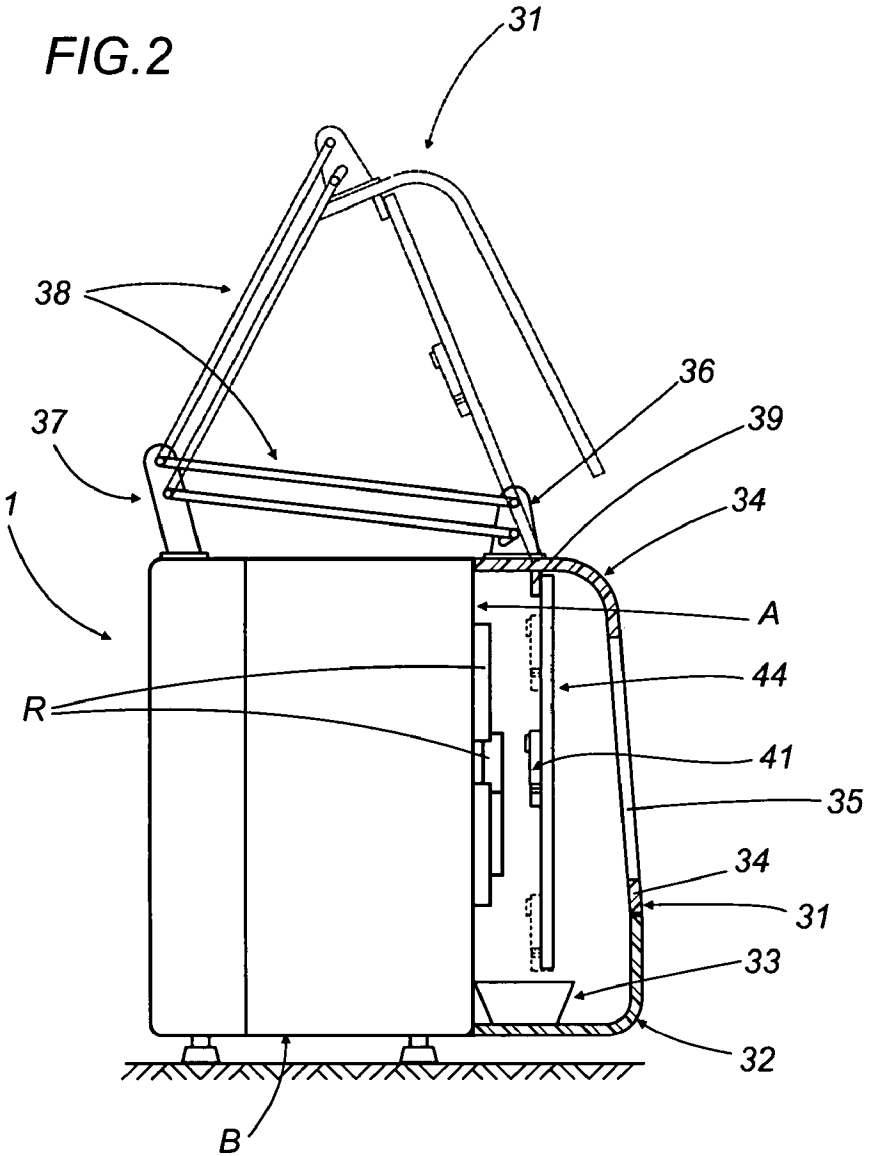
FIG. 2 is a schematic side view of the machine in FIG. 1.

Referring to FIG. 2, the frame B of the machine is equipped with a protective casing 31 positioned over the bulkhead A, also a fixed lower section 32 housing a vessel 33 positioned to collect process waste and tobacco dust.

The casing 31 comprises a metal frame 34 with a substantially central transparent window 35 of which the top part presents a bracket 36 connected to a further bracket 37, associated rigidly in turn with the machine frame B, by way of a pantograph or parallelogram linkage 38. Thus, the casing 31 can be moved, by operating the linkage 38, between a raised position, distanced from the bulkhead A (indicated by phantom lines in FIG. 2), and a lowered position locating against the fixed lower section 32 and shielding the bulkhead A.

Attached to the top part of the movable frame 34, on the inside of the protective casing 31, is a horizontal beam 39 such as will support an upright member 40 carrying inspection means illustrated schematically by a block denoted 41 and mounted by way of a bracket 41*a*.

When the casing 31 is in the lowered position, the beam 39 extends parallel to the bulkhead A and along its full length, whilst the upright member 40 is disposed vertically, extending the full height of the bulkhead A.

The inspection means 41 can be traversed in the two directions indicated by the arrows of FIG. 1 through the agency of first and second drive motors denoted 42 and 43, indicated schematically in this same drawing, along an axis 40*a* coinciding with the upright member 40 and, together with the upright member 40, along an axis 39*a* coinciding with the beam 39. It will be seen that the beam 39 and the upright member 40 provide means by which to support and maneuver the inspection means 41, whilst the beam 39, the upright member 40, the inspection means 41 and the first and second motors 42 and 43 combine to establish an inspection unit 44.

Figure 3:
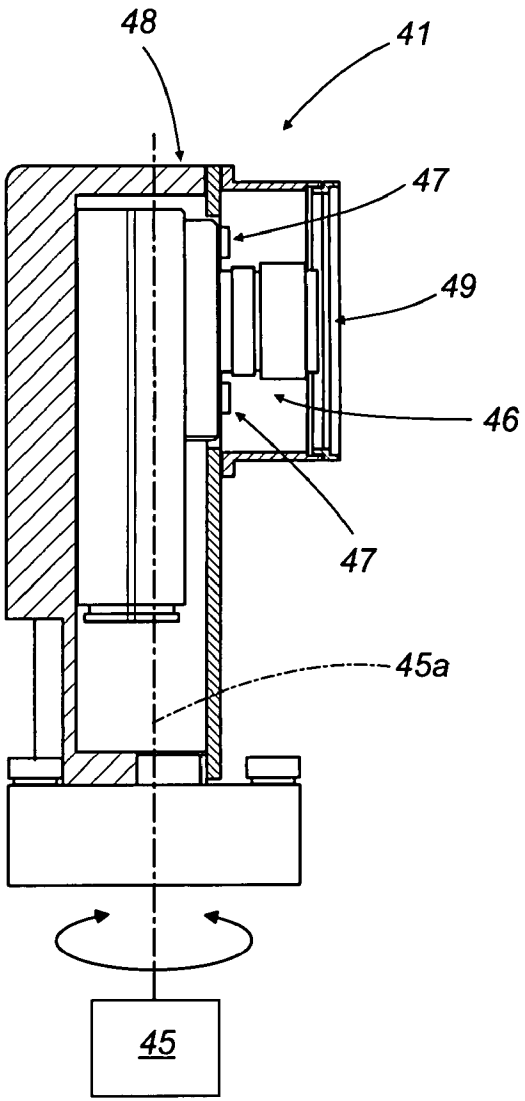
FIG. 3 is an enlarged detail of FIG. 2, viewed schematically and partly in section.

Referring to FIG. 3, the inspection means 41 are associated with a motor 45 such as will induce their rotation about a vertical axis 45*a* in either direction, relative to the mounting bracket 41*a*.

The inspection means 41 are composed of a filming device 46 consisting in a television camera, and a strobe device 47 consisting for example in one or more light sources able to emit flashes alternating with dark periods at adjustable frequencies.

48 denotes a dust-excluding pod, fitted with a transparent window 49, designed to house both the filming device 46 and the strobe device 47.

In use, an operator will be able to position the inspection means 41 at any given point across the bulkhead A, activating the first, second and third drive motors 42, 43 and 45 by way of an electronic master control unit 50 that can be managed from the keyboard 51 of a computer 52. More exactly, two of the motors 42 and 43 can be piloted by the control unit 50, operating in conjunction with conventional positioning means not illustrated in the drawings, to traverse the inspection means 41 along slide ways (likewise conventional and not illustrated) afforded by the upright member 40, and to traverse the upright member along slide ways (conventional and not illustrated) afforded by the beam 39. The third motor 45 also allows the inspected working parts to be filmed from the side.

It will be evident that the inspection means 41 can also operate without the strobe device 47, for example in cases where the examined components are not invested with cyclical motion.

It will be seen also that the inspection unit 44 according to the invention allows an operator to examine all of the parts mounted to the bulkhead A, safely, swiftly and accurately, without any need for the machine 1 to be shut down.

What is claimed is:

1. A machine for manufacturing tobacco products comprising:

a plurality of working parts occupying a predetermined zone of a frame, certain of which at least are invested with cyclical motion, a movable protective casing positionable to shield the parts invested with cyclical motion and associated with the frame by way of a parallelogram linkage in order to be movable between a non operating raised position and an operating lowered position, an inspection unit comprising inspection means;

means by which the inspection means are supported and set in motion along at least two axes, and positionable thus at any given point within the predetermined zone;

wherein the support and motion-inducing means and the inspection means are associated permanently with the movable casing.

2. A machine as in claim 1, wherein the inspection means comprise at least one filming device.

3. A machine as in claim 1, wherein the inspection means comprise at least one strobe device.

4. A machine as in claim 1, wherein the inspection means comprise a filming device operating in conjunction with a strobe device.

5. A machine as in claim 1, wherein the support and motion-inducing means comprise an upright member carrying the inspection means, and a bean to which the upright member is mounted with freedom of sliding movement.

6. A machine as in claim 2, wherein the filming and strobe devices are enclosed within a dust-excluding protective pod.

7. A machine as in claim 2, wherein the support and motion-inducing means comprise third drive means by which the inspection means are made to pivot about a predetermined axis.

8. A machine as in claim 3, wherein the support and motion-inducing means comprise third drive means by which the inspection means are made to pivot about a predetermined axis.

9. A machine as in claim 5, wherein the support and motion-inducing means comprise first and second drive means by which the inspection means are set in motion along the upright member and the upright member, at least, is set in motion relative to the beam.

10. A machine as in claim 9, wherein the support and motion-inducing means comprise third drive means by which the inspection means are made to pivot about a predetermined axis.

11. A machine as in claim 10, wherein the inspection unit comprises an electronic master control unit connected on the input side to the inspection means and on the output side to the first, second and third drive means.

* * * * *